United States Patent [19]

Gray

[11] Patent Number: 4,766,667

[45] Date of Patent: Aug. 30, 1988

[54] APPARATUS FOR TENSION EXPANDING TUBES

[75] Inventor: Kenneth P. Gray, Syracuse, N.Y.

[73] Assignee: Carrier Corporation, Syracuse, N.Y.

[21] Appl. No.: 944,487

[22] Filed: Dec. 22, 1986

[51] Int. Cl.[4] ..... B23P 15/26

[52] U.S. Cl. ..... 29/727; 29/157.3 C; 29/157.4; 29/523

[58] Field of Search ..... 29/767, 727, 157.3 C, 29/157.4, 522 R, 523, 33 G

[56] References Cited

U.S. PATENT DOCUMENTS 3,507,026 4/1970 Collins ..... 29/727
3,824,668 7/1974 Wightman ..... 29/727
4,584,751 4/1986 Gray et al. ..... 29/727
4,584,765 4/1986 Gray ..... 29/727

FOREIGN PATENT DOCUMENTS

0659248* 4/1979 U.S.S.R. ..... 29/727

*Primary Examiner*—Howard N. Goldberg
*Assistant Examiner*—Irene Cuda
*Attorney, Agent, or Firm*—Robert H. Kelly

[57] ABSTRACT

An apparatus for tension expanding a plate fin heat exchanger to provide a heat exchanger with bells of the same form and dimension and then expanding the tube into contact with the tube sheets and hairpin tubes while the bells are clamped to prevent the hairpin tubes from moving.

3 Claims, 3 Drawing Sheets

APPARATUS FOR TENSION EXPANDING TUBES

BACKGROUND OF THE INVENTION

This invention relates generally to heat exchanger coils and more particularly, to a method and apparatus for the belling and expanding of plate fin heat exchanger coils for dimension control.

A plate fin heat exchanger coil is commonly constructed with a plurality of flat, parallel plates having laterally spaced holes therein for receiving refrigerant tubes, or hairpin tubes, therein. At each end of the plate fin bundle, there is a tube sheet composed of heavier material, and adjacent one of the tube sheets, the open ends of the hairpin tubes are fluidly connected by way of U-shaped return bends that are secured thereto by way of soldering, brazing, or the like. When the coils are installed into a refrigeration system, the refrigerant is made to flow through the hairpin tubes, and the air to be cooled or heated is made to flow over the plate fins, such that a heat transfer is thereby affected.

As is known, the tube expansion process is generally carried out by passing tube expanding rods through the open ends of the hairpin tubes and then belling the tube. A backing plate is placed against the tube bends during compressive expansion to prevent the tubes from being driven out of the unit as the expanding tools are forced therethrough. As a result of this holding action the tubes are compressed rearwardly as they are being expanded outwardly by the tools. This in turn, causes the tubes to shrink so that the axial length of each tube can vary dramatically in final assembly. Because of the differences in tube length, belling of the tubes is difficult and generally results in uneven or misaligned bells being formed in the tube ends. The return bends therefore cannot be properly seated within the bells leading to the formation of relatively weak or incomplete solder or braze joints in this critical region. Further, the bell ends can also be uneven, which also makes automatic brazing or soldering difficult.

In order to better facilitate the formation of the tube bells and the joining of the return bends therein, it has been the common practice in the art to bring the open ends of the hairpins a considerable distance out from the adjacent tube sheet. The additional length of tube allows each bell to be brought to full depth without interference from the tube sheet. The unsupported length of tube between the bell and the tube sheet, however, represents the weakest section in the unit. Hydrostatic tests have shown that the flow circuit will generally rupture in this region when exposed to high internal stresses. Beyond weakening the unit the added length of tubing wastes costly material and thus raises the cost of each unit. Furthrmore, the added tube length makes it difficult to compact the unit which in the case of a room air conditioner is of primary importance.

In order to improve the hydrostatic burst strength of a plate fin heat exchanger, a technique for tension expanding hairpin tubes into a fin pack unit, as explained in greater detail in U.S. Pat. No. 4,584,765 was developed. This prior technique was generally carried out on a three row coil which was first belled by a split collet and pin arrangement, and then expanded. Because of the closeness of the heat exchanger tube rows the bells that were formed are simple, single diameter bells, to which pre-tinned return bends are nested. Further, because of the closeness of the heat exchanger tube rows, the jaw members of the tube clamping fixture were relatively long, thin jaw members bowed during the expansion process. Furthermore, the single diameter bell was not suitable for ultrasonic soldering, but had to use pretinned return bends.

Thus, to use ultrasonic soldering, the bell diameter would have had to be increased, which would have required even less space between adjacent tubes, making the jaw member even thinner and subject to more bowing in the horizontal direction.

Thus, there is a clear need for a simple apparatus for belling and tension expanding a plate fin coil which is suitable for ultrasonic soldering or autobrazing a return bend thereto.

SUMMARY OF THE INVENTION

It is an object of the present invention to simplify the manufacture of plate fin heat exchangers.

It is another object of the present invention to bell and then tension expand a plate fin heat exchanger suitable for autobrazing or ultrasonic soldering return bends thereto.

It is a further object of the present invention to provide a plate fin heat exchanger of uniform dimension with all the bells the same form and height.

It is still another object of the present invention to provide an improved automated machine for belling and tension expanding a plate fin heat exchanger.

It is still a further object of the present invention to control exact tube sheet to tube sheet dimensions.

These and other objects of the present invention are attained by a method of belling and then tension expanding a plate fin coil suitable for ultrasonic soldering. The method includes extending the tubes from the coil a selected distance to provide for even tube ends for different length hairpin tubes, compressing the fin pack a desired distance beyond the tube sheet, clamping the tube at the desired distance beyond the tube sheet, actuating belling means at a selected speed to form a bell at the selected distance, removing the belling means and unclamping the tube and extending the compressed fin pack to seat the bell into the tube sheet whereby the desired distance is within the fin pack, transferring the belled fin pack to an expander station, supporting the hairpins in a biased receiver for adjusting the bells into a bell retainer, clamping the bells in the bell retainer, and expanding the tube in tension expansion.

A belling and tension expander apparatus is further disclosed including a belling station having a hairpin receiver for compressing a fin pack for providing a desired extending area, a gripper for providing an interference fit with the desired extending area, and a belling means for belling the ends of the tubes, and an expanding station having a hairpin receiver for biasing the belled ends into a split bell holder for retaining the bell, and an expander means for expanding the tube in tension expansion.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
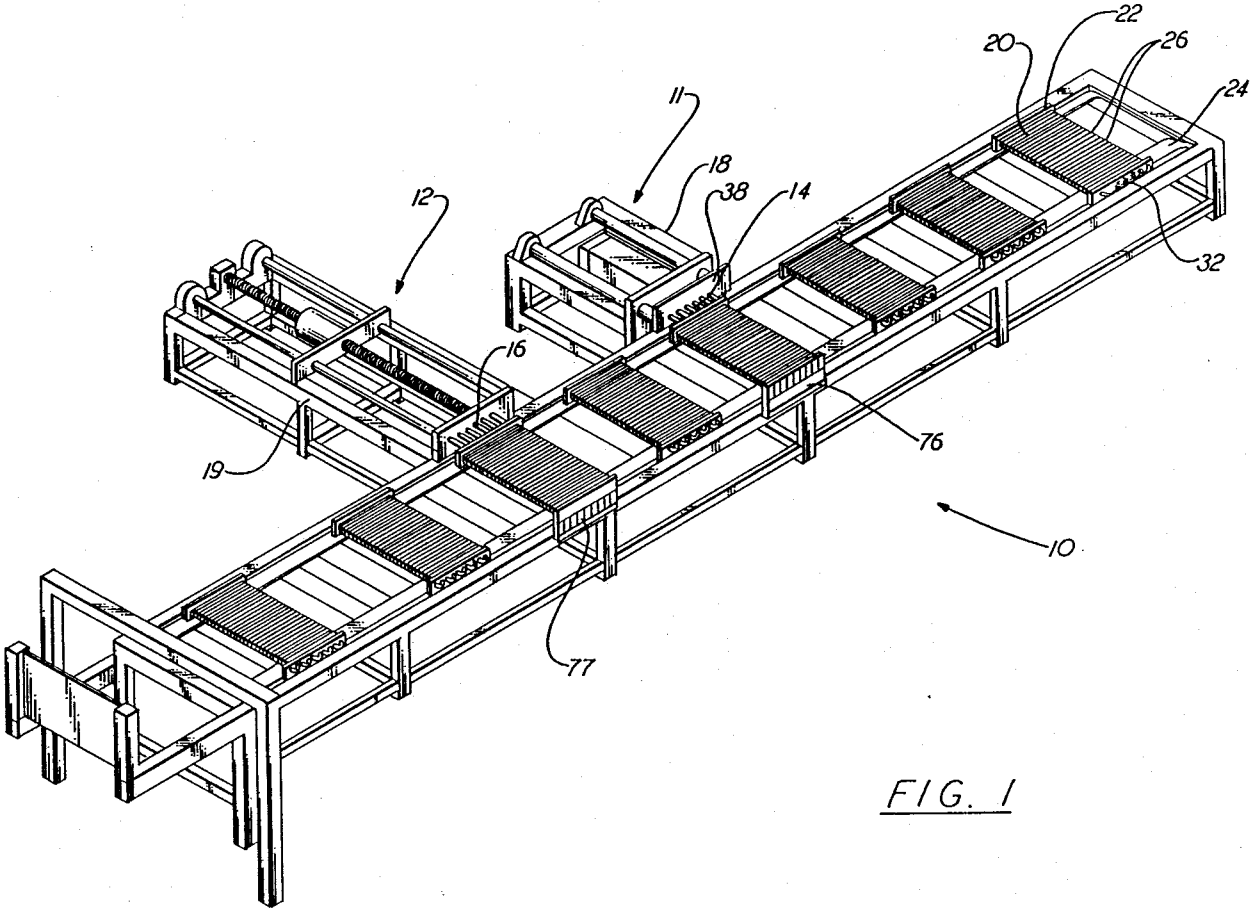
FIG. 1 is a perspective view of a portion of a plate fin coil assembly apparatus embodying the teaching of the present invention.

Referring to FIG. 1, there is shown a portion of a plate fin heat exchanger assembly system 10 with the various components used in accordance with the method and apparatus of the present invention. The present plate fin coil manufacturing apparatus is described in connection with beller station 11 and expander station 12. Prior to arriving at the beller station 11, the plate fin heat exchangers 20 are partially assembled at a lacing station (not shown). As may be seen from the various figures, the plate fin heat exchanger 20 has a plurality of fins 26, a bottom tube sheet 24, and a top tube sheet 22. Hairpin tubes 28 are arranged having a return portion 32 and leg portions 34 such that the leg portions extend through the entire fin bundle and tube sheet 24 to tube sheet 22 and then extend beyond tube sheet 22 defining extension portions 36. The hairpin tubes are physically inserted or laced through arranged openings in the fins and tube sheets into the positions as shown.

The tube belling station 11 includes a plurality of hydraulically actuated beller tools 14 that are mounted on a beller support platform 18. The platform functions to index the plate fin heat exchanger within the beller station so that the open ends of the hairpin tubes are in alignment with the beller tools 14. In this particular embodiment, the plate fin heat exchangers are single row aluminum coils, thus, the beller tools 14 can bell the entire row in one step. Further, the beller station 11 includes a plurality of spring loaded hairpin receivers 76 which push the hairpin tubes 28 through split block tube clamp 38. The hairpin receivers 76 insure that all the tube ends will be even if there are length differences in the hairpin tubes 28. Further, the expander station 12 of FIG. 1 includes a plurality of hydraulically operated bullet rods 16 mounted on support platform 19. Similar to the beller station, the bullet support platform functions to index the belled plate fin heat exchanger 20 within the expander station 12 so that the tubes may be expanded into the fins and tube sheets as described further hereinafter. A spring loaded expander retainer 77 is located at the expander station 12 immediately behind the return bend portion 32 of the hairpin tubes.

Figure 2:
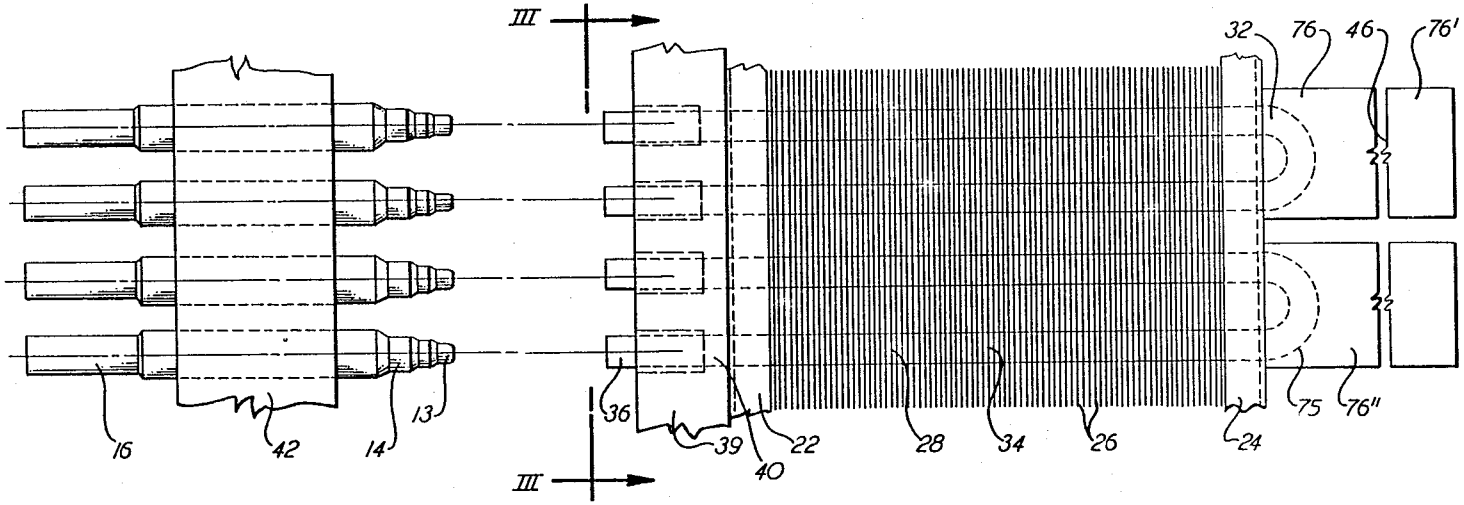
FIG. 2 is an enlarged top plan view showing the belling means of the present invention.
Figure 3:
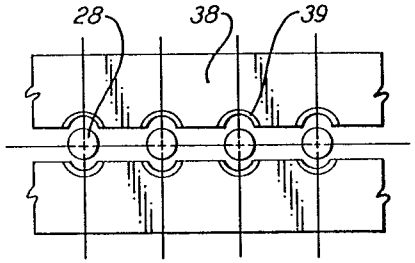
FIG. 3 is a section taken along line III—III of FIG. 2.
Figure 4:
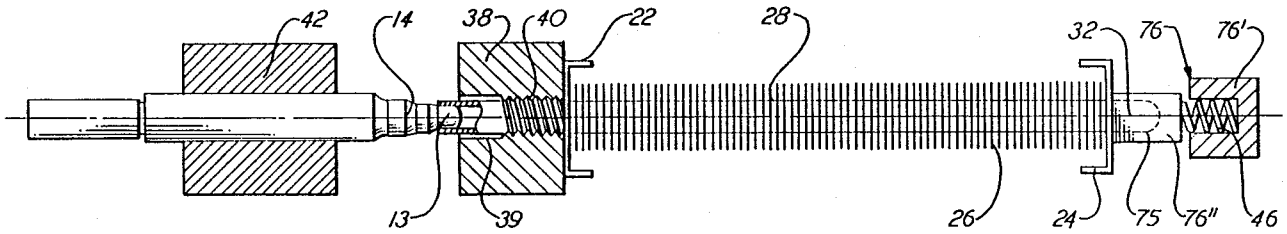
FIG. 4 is an enlarged side elevation view partly broken away showing the belling means of the present invention.

Turning now to FIGS. 2–4 there is shown in greater detail the belling station 11 of FIG. 1. The belling tools 14 are guided into contact with the open ends of the extension portions 36 of the hairpin tubes 28 by a bell guide 42. The hairpin receiver 76 includes a fixed portion 76' and a movable portion 76''. The two portions of the hairpin receiver are connected by a spring means 46. The movable portion 76'' includes a U-shaped holder 75 matingly engaging with the return bend portion 32 of the hairpin tube 28. A split block tube clamp 38 having a recess 39 and a gripping area 40 clamps the hairpin tubes during the belling operation.

Initially, upon a plate fin heat exchanger 20 being indexed into the belling station 11 the movable hairpin receiver portion 76'' moves the hairpin tube 28 so that the leg portions 34 are inserted through the split block tube clamp 38 so that the tube ends are located in alignment with the beller tools 14 having a lead-in 13 and the top tube sheet 22 is stopped against the rear surface of the tube clamp 38. In this manner the fins 26 and tube sheets 24, 22 of the plate fin heat exchanger are compressed so that the gripping area 40 of the split block tube clamp 38 grips the surface of the extension portion 36 of the hairpin tubes. Once the tube clamp 38 is closed providing a slight interference fit to give positive clamping force on the tube, the belling tools 14 are forced into the extension portions 38 to form the desired double diameter bell necessary for ultrasonic soldering.

Once the bells have been formed, the hydraulic pressure on the beller tools 14 is released and the beller tools move back away from the tubes and the gripping force of the tube clamp 38 on the hairpin tubes is released. The belled plate fin heat exchanger 20 may now be indexed into the expander station.

Figure 5:
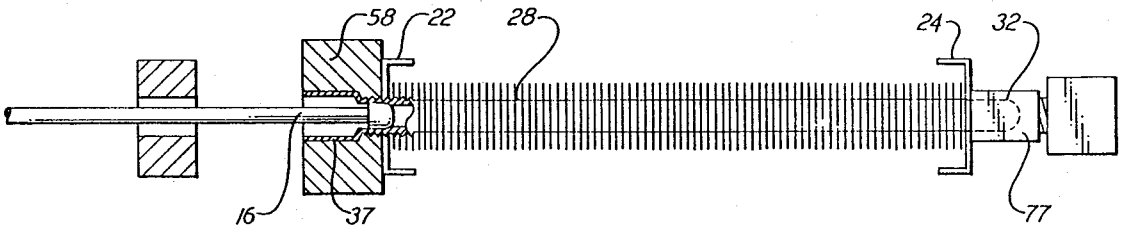
FIG. 5 is an enlarged side elevation view partly broken away showing the tension expanding means of the present invention.

Upon clearing the beller station 11 the plate fin heat exchanger 20 is indexed into the expander station 12. Moreover, the plate fin heat exchanger 20 which had been previously compressed now extends so that the belled portion 37 seats into the top tube sheet 22, as shown in FIG. 5. This seating of the bell into the tube sheet is necessary to provide burst strength at the tube to bell transition area. Further, the extension portion 36 that had been previously clamped in the belling station is now within the plate fin heat exchanger. As shown in FIG. 5, the operation of the expander station 12 is similar to the belling station 11. In operation, the expander retainer 77 pushes the belled portion 37 of the hairpin tube 28 through a split block bell holder 58 and the bullet rods 14 are positioned in the belled portion 37 to locate the top tube sheet 22 against the back portion of the split block bell holder 58. The split block bell holder 58 is a retainer means and not a clamp means, therefore there is no interference fit so that the bullet rods 16 can pass into the tube. With the split block tube clamp 38 closed on the belled portion 37 of the hairpin tubes 28 the bullet rods 16 are hydraulically actuated to expand the tube into the tube sheets and fins using tension expansion. The expander retainer 77 may be left in contact with the return bend portion 32 of the hairpin tube 28 to prevent coil growth and eliminate tube sheet to tube sheet length change.

While a preferred embodiment of the present invention has been depicted and described, it will be appreciated by those skilled in the art that many modifications, substitutions, and changes may be made thereto without departing from the true spirit and scope of the invention.

What is claimed is:

1. An apparatus for tension expanding tubes into a plate fin heat exchanger unit having parallel hairpin tubes passing in rows through fin plates and tube sheets of the unit comprising:

indexing means for positioning the open end of the tubes a predetermined distance beyond a desired final position in one of the tube sheets, said predetermined distance equal to the final desired bell length plus an additional desired length;

clamping means for providing a clamp force to hold the tubes, said clamping means gripping the tubes along said additional desired length;

bell forming means for deforming the open end of the tubes radially outward to form a bell having a length equal to said final desired bell length;

seating means for seating said bell adjacent said one of said tube sheets, said bell being arranged to position the open end of the tubes a distance beyond said one of said tube sheets equal to said final desired bell length;

retaining means for retaining said bells along the final desired bell length to restrain the tubes from axial movement during expansion; and tube expanding means for passing expanding bullets into each tube through the bell or end thereof to expand the tube walls into contact with the fin plates and tube sheets of the unit whereby the forces due to expansion are supported by said bells.

2. An apparatus for tension expanding tubes into a plate fin heat exchanger as set forth in claim 1, further comprising:

receiver means for movably engaging the hairpin end of the tubes, said receiver means having a biasing means to prevent coil growth when the tubes are expanded.

3. An apparatus for tension expanding tubes as set forth in claim 1 wherein said bell forming means is positioned at a first manufacturing station and said tube expanding means is positioned at a second manufacturing station.

* * * * *